US006070044A

United States Patent [19]

Hoffmann et al.

[11] Patent Number: 6,070,044

[45] Date of Patent: May 30, 2000

[54] DEVICE FOR APPLYING RELEASE AGENT TO THE SURFACE OF A FIXING ROLLER OF AN ELECTROGRAPHIC PRINTER OR COPIER

[75] Inventors: Joachim Hoffmann; Stephen Nicholas Huntley, both of München, Germany

[73] Assignee: OcéPrinting Systems GmbH, Poing, Germany

[21] Appl. No.: 09/117,319

[22] PCT Filed: Aug. 27, 1996

[86] PCT No.: PCT/DE96/01588

§ 371 Date: Nov. 16, 1998

§ 102(e) Date: Nov. 16, 1998

[87] PCT Pub. No.: WO97/27518

PCT Pub. Date: Jul. 31, 1997

[30] Foreign Application Priority Data

Jan. 26, 1996 [DE] Germany ..... 196 02 774

[51] Int. Cl.[7] ..... G03G 15/20

[52] U.S. Cl. ..... 399/325; 118/DIG. 1

[58] Field of Search ..... 118/257, 260, 118/263, DIG. 1; 242/333.5, 333.6; 427/428; 399/324, 325

[56] References Cited

U.S. PATENT DOCUMENTS

| | | | |
|---|---|---|---|
| 4,569,864 | 2/1986 | McIntyre | 427/428 |
| 5,576,821 | 11/1996 | Rasch et al. | 399/325 |
| 5,836,532 | 11/1998 | Thompson | 242/35.5 |

*Primary Examiner*—Arthur T. Grimley
*Assistant Examiner*—Hoang Ngo
*Attorney, Agent, or Firm*—Hill & Simpson

[57] ABSTRACT

A printer or copier using transfer printing has a fixing drum for fixing toner on a medium, such as paper. Parting liquid, or release agent, is applied to the fixing drum using an application element, the application element being moved over the surface of the fixing drum as it is unwound from a supply roll and wound onto a take-up roll. The speed of the supply roll is sensed and the motor of the take-up roll is controlled so that the speed of the application element is constant regardless of changes in the diameter of the application element on the supply roll. The speed of the supply roll may be sensed with a magnet and Hall sensor arrangement.

6 Claims, 2 Drawing Sheets

Figure 1:
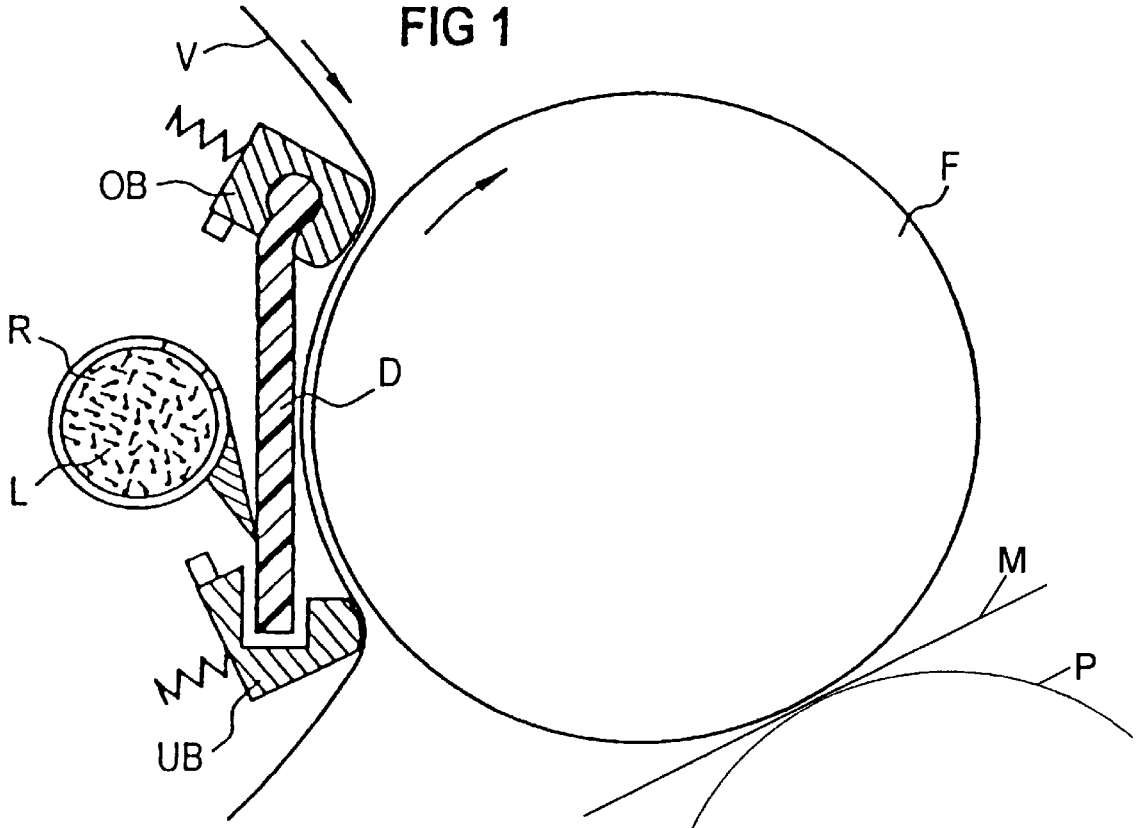

DEVICE FOR APPLYING RELEASE AGENT TO THE SURFACE OF A FIXING ROLLER OF AN ELECTROGRAPHIC PRINTER OR COPIER

The invention is directed to a release agent application means. The release agent application means applies parting liquid onto the surface of a fixing drum of an electrographic printer or copier device working according to the transfer printing principle.

In electrographic printer or copier devices, charge images are generated on an intermediate carrier, for example a photoconductor drum, these then being inked with a developer mix of a developer station on the basis of electrostatic or magnetic forces. The inked charge images are transfer-printed onto a recording medium in the form of single sheets or continuous stock in a transfer printing station and are subsequently thermally fixed. For thermal fixing, U.S. Pat. No. 3,324,791 discloses that a fixing station with two drums between which the carrier of the toner image is moved past be employed. The one fixing drum facing toward the toner image is heated, the other presses the carrier with the toner image against the fixing drum. The toner is then melted in by heat and pressure.

In order to prevent toner from remaining adhering to the surface of the fixing drum, the surface thereof is moistened with parting liquid, for example silicone oil. For applying this parting liquid onto the fixing drum, DE-C-39 42 147 discloses a release agent application mans wherein an application element composed of felt is pressed against the fixing drum by a pressing member extending along the fixing drum. A dosing tube that contains discharge openings in its longitudinal extent is provided at that side of the application element facing away from the fixing drum. Release agent pumped into the dosing tube emerges from the openings and thus proceeds onto the application element.

The application element picks up the release agent and transfers it to the surface of the fixing drum. The absorbency is determined by the material, by the thickness of the material and the degree to which the material is contaminated. Thick fleeces are employed as application elements. These can absorb a specific amount of dirt. With increasing contamination, however, the fleece will allow less and less release agent through to the fixing drum, so that it prevents the delivery of release agent to the fixing drum in the extreme case. For this reason, the fleece is renewed continuously or at chronological intervals. To that end, DE 38 42 147 provides a supply roll on which the fleece is wound. A take-up roll in turn winds up dirty fleece.

The transport speed of the fleece is determined by the constant rotational speed of the take-up roll. The transport speed of the fleece therefore rises with increasing diameter of the take-up roll. The cleaning effect of the fleece increases with the transport speed of the fleece. The transport speed of the fleece is therefore designed such that the lower speed at the start of the fleece is just still adequate in order to achieve an adequate cleaning effect. Although the length of the fleece is relatively slight due to its thickness and the spatial limitations connected therewith, a high transport speed of the fleece that is too high for achieving a satisfactory cleaning effect occurs at the end of the fleece supply. This causes a frequent replacement of the fleece and, thus, short maintenance intervals.

The present invention is therefore based on the object of fashioning a release agent application means for applying release agent to the surface of a fixing drum of an electrographic printer or copier device such that a lengthening of the maintenance intervals is achieved given a constant and dependable cleaning effect.

This object is achieved by the features recited in patent claim 1. Improvements and developments of the invention are recited in subclaims.

The application element is wound on a supply roll. A sensor that acquires the rotational speed, for example in the form of pulses, is coupled to the supply roll. It outputs these pulses to a control unit that in turn controls the speed of a motor that drives the take-up roll. The rotational speeds of both rolls are thus known to the control unit. Over and above this, the total length of the application element is known. The control unit calculates the actual speed of the application element from these quantities and compares this to a rated speed, the control units decelerates or accelerates the motor speed according to the comparison result, so that a constant transport speed of the application element that corresponds to the rated speed is achieved as a result.

According to an improvement and development of the invention, the control unit also identifies the end of the application element. In previous solutions, the end of the application element was designed such that it actuated an off switch as soon as it was pulled from the supply roll. Failures of the switch to be actuated thereby occurred, so that the end of the application element came into contact with the surface of the fixing drum. Given a corresponding fashioning of the end, for example a ledge was attached thereat, this could lead to the destruction of the fixing drum. As a result of the inventive solution, the control unit recognizes the end [ . . . ] application element due to the stand still or the slowing of the supply roll and subsequently switches the motor off. Additionally, a corresponding message can be output to the central control of the electrographic printer or copier device.

According to a further improvement and development of the invention, a fleece having a thickness between 0.2 through 0.3 mm serves as application element. This fleece is significantly thinner than traditional fleeces. Polyaramide, polyemide [sic] and Teflon or combinations thereof is preferably employed as fleece material. A greater length of the fleece can be wound on a small space with the thin fleece. Given unmodified maintenance intervals, an increased fleece speed can be realized due to the increased fleece length. A higher quality of the cleaning of the fixing drum is assured as a result thereof because a blockage of the fleece by dirt can be prevented. The thin fleece enables a fast and direct oiling of the fixing drum. A particular advantage is revealed in the improved capillary action and absorbency. The transfer of the release agent to the fleece with the assistance of the wick assures an optimum wetting of the fleece independently of thermal and geometrical tolerances.

An example of the invention is explained in greater detail below on the basis of the drawing. Thereby shown are:

FIG. 1 a schematic sectional view of a release agent application means with fixing drum; and A release agent application means (shown in FIG. 1) for applying release agent L onto the surface of a fixing drum F is allocated in [sic] a thermal fixing station in an electrographic printer or copier device that is not shown in detail here. The schematic illustration shows the fixing drum F, which rotates in a clockwise sense. The pressure drum of the fixing station and the recording medium guided between the two drums are not shown. However, the device for applying release agent onto the surface of the fixing drum F is shown. A fleece that exhibits a thickness of 0.2 through 0.3 mm serves as application element V. It is composed of polyarmide [sic], polyemide [sic] or Teflon. The application element V applies silicone oil or some other suitable, heat resistant release agent onto the entire surface of the fixing drum F, preferably in liquid form. In order to assure this, the application element V has its entire width extending over the entire axial length of the fixing drum F. Over and above this, the application element is applied against the fixing drum F in a pre-determined circumferential region.

In the operating condition, the application element V is constantly in contact with the surface of the fixing drum F. The application element V thereby picks up dirt particles such as, for example, toner particles or duct entrained by the recording medium. In order to assure a faultless function, the region of the application element V lying against the fixing drum F is preferably renewed in sections either continuously slowly but potentially also in chronological intervals, as explained in greater detail below in conjunction with FIG. 2. To that end, a supply roll VV from which the application element V is unwound as well as a take-up roll AV that winds up the used application element V is provided. The take-up roll AV is driven, for example, by a motor MO. The transport direction of the application element V produced by the motor MO runs opposite the motion of the fixing drum F, so that the used application element V entrains all contaminants picked up by being stripped from the surface of the fixing drum F, and an adequate surface of relatively fresh application element V is always available.

The circumferential region at which the application element V resides [ . . . ] with the surface of the fixing drum F is defined by the spacing of two guide elements OB, UB extending parallel to one another in axial direction of the fixing drum F. These guide elements UB, OB are arranged vertically above one another, so that one can speak of an upper guide element OB and a lower guide element UB. The two guide elements UB, OB are pressed to the surface of the fixing drum F by springs S1, S2 that are arranged in the region of the end faces of the guide elements UB, OB.

The guide elements UB, OB fulfill another task in addition to their guide function for the application element V. They hold a wick D to which release agent L is supplied from a release agent dosing tube. The wick D is in physical contact with the application element V, as a result whereof release agent L can be picked up by the application element. This can then output the release agent L to the fixing drum F.

Figure 2:
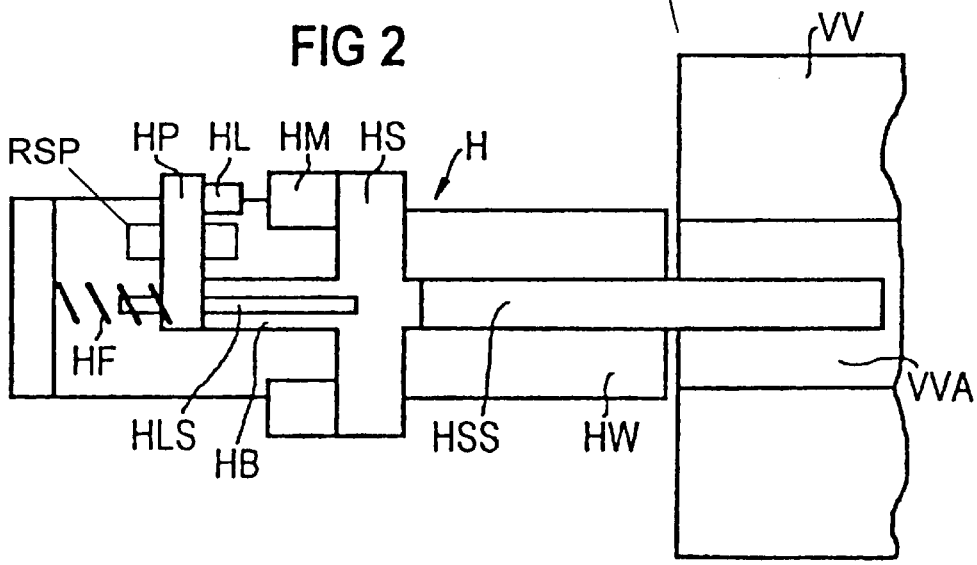

According to FIG. 2, the application element V is unwound from a supply roll in clockwise direction, conducted along the fixing drum F and wound up by a take-up AV. The take-up roll AV is driven counter-clockwise by a motor MO. The rotational speed of the supply roll VV is acquired by a sensor H. The speed of the motor MO is determined by a control means CON. This control means CON is coupled to the sensor H and interprets the information supplied by the sensor.

Upon insertion of a new supply roll VV, this comprises a large outside diameter. The diameter of the take-up roll AV is correspondingly small since, for example, only one layer of the application element V is situated on the take-up pipe AVR of the take-up roll AV. A constant motor speed would result in a constant rotational speed of the take-up pipe AVR. A rise in the transport speed of the application element would then occur with increasing diameter of the take-up roll AV. The diameter of the supply roll VV diminishes to the degree to which the diameter of the take-up roll AV increases. The rotational speed of the supply roll VV consequently rises when the application element V is unwound if one assumes a constant speed of the application element V.

Due to the information present from the sensor H, the control unit CON knows the rotational speed of the supply roll VV. The control unit CON itself determines the rotational speed of the take-up roll AV, for which reason this rotational speed is also known. The control unit compares the motor speed to the speed of the supply roll W and determines the extent to which the application element V is already unwound therefrom. It calculates the diameter of the supply roll VV therefrom. The actual speed of the application element V can be calculated from the diameter of the supply roll VV and its speed. This actual speed of the application element V is compared to a rated value. When the actual value deviates from the rated value, the control unit CON correspondingly adapts the speed of the motor MO. When the motor MO is a stepping motor, the on/off duration of this stepping motor MO is correspondingly modified.

Figure 3:
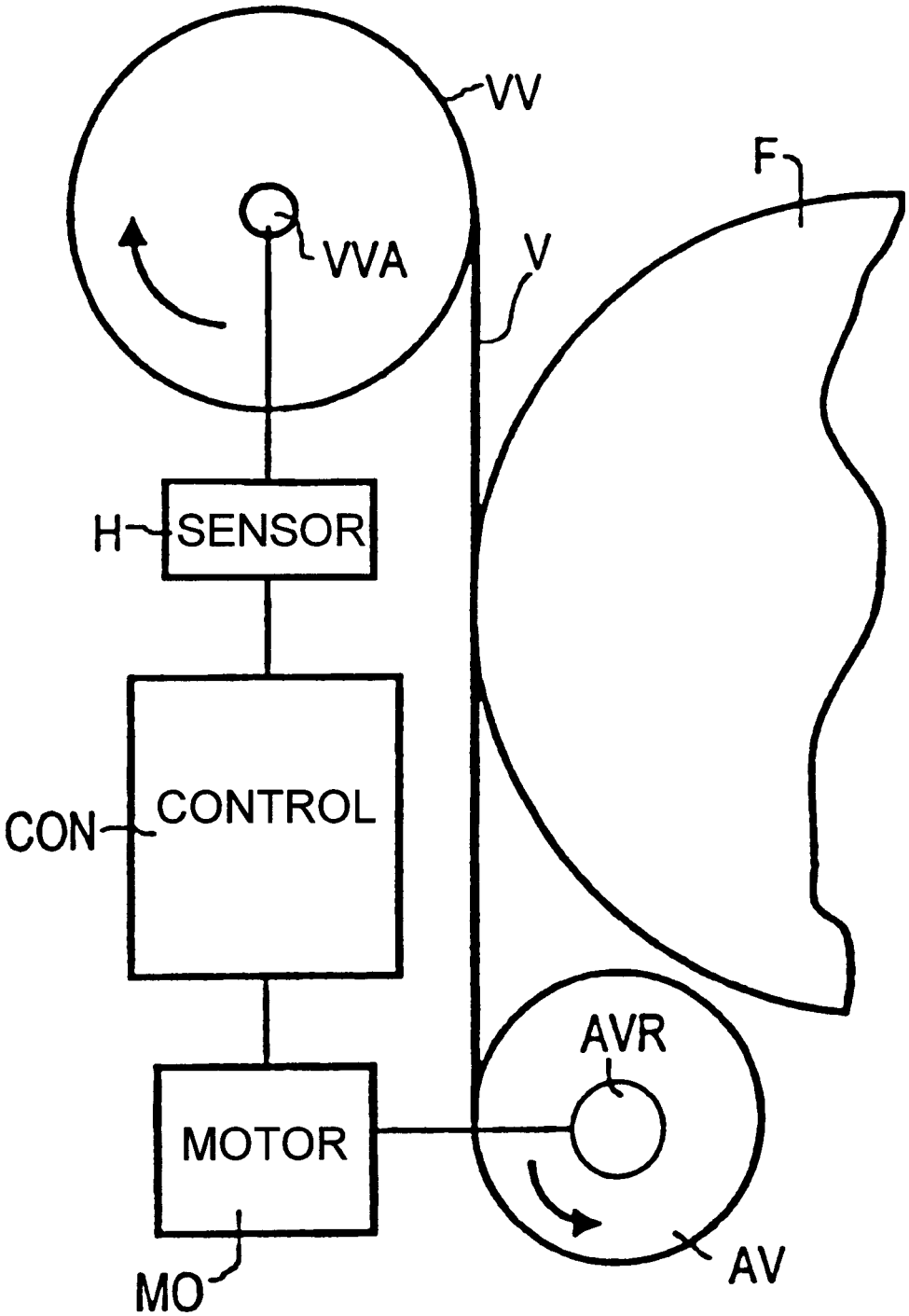

A Hall sensor H is utilized for determining the rotational speed of the supply roll VV. According to FIG. 3, the Hall sensor H is arranged at the end face of the supply roll VV. Individual magnets or a magnet ring are arranged on a circular disk HS that is coaxially coupled to a pin HSS, being arranged at uniform intervals on that side facing away from the end face of the supply roll. The pin HSS penetrates coaxially into the axle WA of the supply roll VV and is thus coupled [ . . . ] this [ . . . ] that the pin HSS transmits the rotational motion of the axle of the supply roll VV onto the disk HS. A Hall element HL is allocated to the magnets HM located on the disk HS. It is stationarily located in the immediate proximity of the magnet HM turning around the pin HSS.

A reliable function of the hall sensor HL is only assured when extremely narrow tolerances, for example +/−0.2 millimeters, with respect to the spacing from the magnets HM are adhered to both in radial as well as in axial direction. These narrow tolerances are adhered to in that the pin HSS projects a defined length from the surface of the disk HS. This part of the pin HSS is located on the same side as the magnets HM. In this region, the pin HSS comprises an axial bore HB into which a pin HLS in communication with the Hall sensor HL can be introduced. A receptacle plate HP that resides parallel to the surface of the disk HS carrying the magnets HM is secured to this pin HLS. The Hall sensor HL is arranged at that side of the plate HP facing toward the magnets HM. The plate HP is supported on a stationary angle HW, so that a rotational motion of the pin HSS coupled to the disk HS is not transmitted onto the pin HLS coupled to the plate HP and, thus, a stationary position of the hall sensor HL is achieved in radial direction.

For securing the stationary position of the Hall sensor HL in axial direction, the plate HP is axially pressed by a spring HF against the end face of the pin HSS coupled to the disk HS. The spring HF is thereby supported at the stationary angle HW. Given an appropriately exact fabrication of the elements of the sensor H, the required narrow tolerances can be adhered to without requiring an additional adjustment work in the mounting of the sensor H.

The structuring of the sensor H can also ensue in an inverse way. A magnet HM can be arranged on the plate HP. Accordingly, a plurality of Hall sensors HL would have to be arranged on the disk HS instead of the magnets HM. As a further alternative, a single magnet can be arranged on the disk HS, and the plate HP can be implemented of such a large size that a plurality of Hall HL sensors can be stationarily arranged thereon. The rotating magnet would then influence the plurality of Hall sensors HL on its way.

The sensor H thus acquires any and all movement of the supply roll VV. Electrical pulses are communicated to the control unit CON at specific time intervals dependent on the rotational speed. When the control unit CON receives no pulses from the sensor H within the time intervals known to it, even though the motor MO is driving the take-up roll AV, the control unit CON recognizes the end of the application element V. The control unit CON outputs a corresponding message to the controller of the printer or copier device, so that a new roll with application element V can be inserted into the device.

We claim:

1. Release agent application means for applying release agent (L) onto the surface of a fixing drum (F) of a printer or copier device working according to the transfer printing principle, comprising an application element (V) fashioned as cleaning band that can be brought into contact with the fixing drum (F) and that applies the release agent onto the fixing drum (F);

a supply roll (W) on which the application element is wound and can be unwound to a take-up roll (AV);

a sensor (H) for the acquisition of the rotational speed of the supply roll (VV); and a control unit (CON) that determines the diameter of the supply roll (VV) from the rotational speed acquired with the sensor and from the length of the application means (V) and controls a motor (MO) driving the take-up roll (AV) such that a constant transport speed of the application means (V) is assured, and that determines the end of the application element (V) on the supply roll (VV) from the data about the speed of the supply roll (VV) supplied by the sensor (H) and subsequently shuts off the motor.

2. Release agent application means according to claim 1, comprising a fleece exhibiting a thickness of 0.2 through 0.3 mm as application element (V).

3. Release agent application means according to claim 2, comprising a fleece composed of polyamide, polyimide or Teflon.

4. Release agent application means according to one of the claims 1 through 3, comprising a control unit (CON) that determines the end of the application element (V) in that is compares the data supplied from the sensor (H) to a rated range in which the data must be located.

5. Release agent application means according to one of the claims 1 through 4, whereby the sensor (H)

contains a disk (HS) coaxially coupled to the axle (VVA) of the supply roll (VV), magnets (HM) or Hall sensors (HL) that follow the rotational movement of the supply roll (VV) being located on said disk (HS), a Hall sensor (HL) or, respectively, magnet (HM) arranged stationarily with respect to the rotating magnets (HM) or Hall sensors (HL) in their influencing region that can be pressed against a spacer (HSS) in axial direction.

6. Method for controlling the speed of an application element (V) of a means for applying release agent (L) onto the surface of a fixing drum (F) of a printer or copier device working according to the transfer printing principle, whereby the application element (V) fashioned as cleaning band that can be brought into contact with the fixing drum (F) is wound on a supply roll (VV) from which it is unwound to a motor-drive take-up roll (AV), a sensor (H) acquires the rotational speed of the supply roll (VV), and a control unit determines the diameter of the supply roll (VV) from the rotational speed acquired with the sensor and from the length of the application means (V), controls a motor (MO) driving the take-up roll (AV) such that a constant transport speed of the application means (V) is assured, and determines the end of the application element (V) on the supply roll (VV) from the data about the speed of the supply roll (VV) supplied by the sensor (H) and subsequently shuts off the motor.

* * * * *